United States Patent [19]

Anderson

[11] Patent Number: 4,925,181

[45] Date of Patent: May 15, 1990

[54] SWIMMING POOL WATER CANNON

[76] Inventor: Russell W. Anderson, 2415 College Ave., #32, Berkeley, Calif. 94704

[21] Appl. No.: 335,862

[22] Filed: Apr. 10, 1989

[51] Int. Cl.[5] ..... A63G 31/00

[52] U.S. Cl. ..... 272/1 B; 446/153

[58] Field of Search ..... 272/1 B, 1 R, 8 R; 446/153; D21/59, 236

[56] References Cited

U.S. PATENT DOCUMENTS

| | | |
|---|---|---|
| 117,723 | 8/1871 | Baker . |
| 952,313 | 3/1910 | Droz . |
| 2,954,736 | 10/1960 | Garland . |
| 2,983,508 | 5/1961 | Modine . |
| 3,091,453 | 5/1963 | Bennett . |

*Primary Examiner*—Richard E. Chilcot, Jr.
*Attorney, Agent, or Firm*—Schapp and Hatch

[57] ABSTRACT

An amusement device for forcibly propelling a coherent water jet from a body of water such as a swimming pool utilizing a housing having a generally tapering open passage from one end to the other, with the larger end of the passage being open and essentially unobstructed for admitting water freely into the passage when the larger end is at least partially submerged in the body of water, the smaller end of the passage being formed to provide an open but constricted nozzle whereby quantities of water forced into the passage through the larger end are accelerated and ejected forcibly through the nozzle to form a substantially coherent water jet capable of traversing significant distance before breaking up, control and actuation of the device being provided for by handles on opposite sides of the housing adjacent to the larger open end. A modified form of the invention mounts a pair of conical housings in side-by-side relation for joint action.

5 Claims, 1 Drawing Sheet

SWIMMING POOL WATER CANNON

BACKGROUND OF THE INVENTION

1. Field of the Invention

This invention relates to water cannons capable of propelling a jet of water over considerable distances, and more particularly to a water cannon adapted for use as an amusement item in swimming pools and the like.

2. Description of the Prior Art

A common form of amusement among swimmers in a swimming pool or other body of water is to push their cupped hands rapidly along the surface of the water in such manner as to project a jet or spray of water for several feet. A device for projecting water in this manner is shown and described in U.S. Pat. No. 3,091,453 to Sherman A. Bennett. This device is worn on the hand of the user and has the effect of making a larger area than can be accomplished by the hand alone. The Bennett device has a reverse curve designed to scoop up water from the surface as the hand is moved forwardly and then project a stream of the water in the same direction the hand is moving.

U.S. Pat. No. 2,983,500 shows a spray producing scoop to be used behind an outboard motor to throw up a spray of water and give the impression of the "rooster tail" created by high-powered, high-speed racing motor boats.

Other patents showing various types of scoops are listed as follows:

| Patent No. | Inventor | Issue Date |
|---|---|---|
| 117,723 | R. Baker | 08/08/1871 |
| 952,313 | E Droz | 03/15/10 |
| 2,954,736 | C. Garland | 10/04/60 |

The above-listed patents are believed to be relevant to the present invention because they were adduced by a prior art search made by an independent searcher, and a copy of each of the above-listed patents is supplied to the Patent and Trademark Office herewith.

The term "prior art" as used herein or in any statement made by or on behalf of the applicant means only that any document or thing referred to as prior art bears, directly or inferentially, a date which is earlier than the effective date of this application.

No representation nor admission is made that any of the above-listed documents is part of the prior art in any acceptation of that term, or that no more pertinent information exists.

SUMMARY OF THE INVENTION

The present invention provides a swimming pool water cannon capable of forcibly propelling a water jet from the surface portion of a body of water such as a swimming pool. The device is capable of projecting a reasonably coherent jet for comparatively long distances before the jet breaks up into spray. The device is capable of being operated by a swimmer floating in the pool or other body of water and the jet of water can be aimed with fair precision. This makes it possible to play water games in which various targets are to be struck by the forcible jet of water, thus greatly enhancing the amusement properties of the device.

Basically, the device of the present invention is in the form of a housing having an open passage narrowing from wide at the rear of the housing to narrow at the front of the housing, and is operated by submerging the open rear end at least partially in the water, with the narrow front or nozzle end out of the water, and then jerking or abruptly moving the housing backward. This causes water trapped in the large open end to be pushed forcibly through the narrowing passage (thus greatly increasing its velocity) to be ejected through the nozzle end in the form of the desired water jet.

Preferably, the housing is in the form of a truncated cone having a longitudinal axis, with the base of the cone cut off to provide the open large end and the top of the cone cut off to provide the open small end. Manually engagable handle means is provided on the cone, preferably near its base, the handle means being formed for grasping and pulling the cone rearwardly in the direction of the large end with the large end at least partially submerged in the body of water and with the small end above the surface of the body of water so as to eject forcibly a jet of the water through the small end of the cone substantially along its axis.

The handle means may be attached to opposite sides of the cone and project therefrom for manual grasping, or may be provided by diametrically opposed openings cut through the wall of the cone.

In a modified form of the invention, a plurality of cones are mounted in side-by-side relation with their axes in generally parallel spaced relation so that the jets of water are ejected from the cones in generally parallel relation to each other. If desired, the small ends of the cones may be provided with simulated gun muzzles and a simulated gun sight may be mounted on the cones to further increase the amusement value.

It is therefore a principal object of the present invention to provide an amusement device capable of forcibly propelling a coherent water jet from a body of water, with said device being operable by a swimmer floating in the water.

Another object of the present invention is to provide a device of the character described which is provided by a unitary truncated conical housing of material capable of floating in the water if released by the user.

A further object of the present invention is to provide a device of the character described which is capable of projecting a plurality of the described jets of water in generally parallel relation to each other.

Other objects and features of advantage will become apparent as the specification progresses and from the claims.

Figure 1:
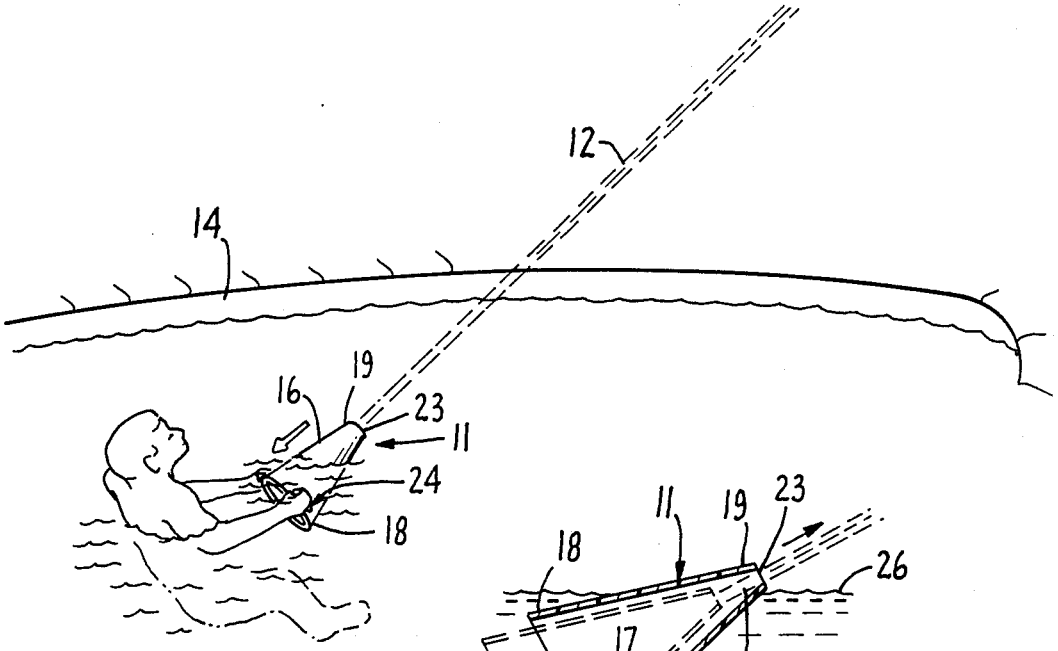
FIG. 1 is a perspective view of a swimming pool water cannon constructed in accordance with the present invention and shown in use in a of a swimming pool.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings, the swimming pool water cannon of the present invention provides an amusement device 11 capable of forcibly propelling a coherent water jet 12 from a body of water 13, such as that contained in a swimming pool 14, over a considerable distance both within and outside the swimming pool area. The device 11 is capable of projecting the water jet for distances ranging from 15 feet to 30 feet, or more, before the jet breaks up and becomes spray.

The amusement device 11 utilizes a housing 16 providing a generally tapering open passage 17 through the housing from one end 18 to the other end 19. The larger end 21 is open and essentially unobstructed for admitting water freely into the passage 17 through the larger end 21 when such a larger end is at least partially submerged in the body of water 13.

The smaller end 22 of the passage 17 is formed to provide an open, but constricted nozzle 23 so that quantities of water forced into the passage 17 through the larger end 21 are accelerated and ejected forcibly through the nozzle 23 to form a substantially coherent water jet 12 capable of traversing significant distances before breaking up.

Housing 16 is provided with manually engagable handle means formed for rapidly pulling or jerking the housing 16 rearwardly through the surface layer 26 of the body of water 13, with the nozzle 23 above the surface of the body of water 13 so as to force quantities of water into the larger end 21 of the passage 17 and forcibly eject a jet 12 of water through the nozzle 23.

Figure 2:
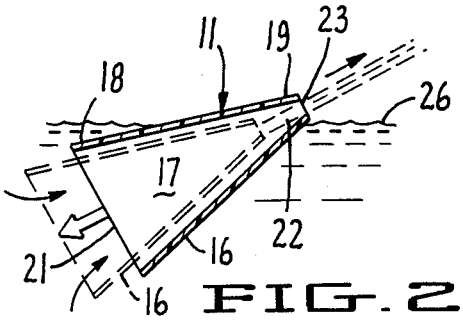
FIG. 2 is a vertical cross-sectional view of the water cannon of FIG. 1 showing its relationship to the surface of the body of water and illustrating the two terminal positions of the device when in use.

FIG. 1 of the drawings illustrates the amusement device 11 in action, and FIG. 2 of the drawings illustrates the described motion of the housing 16 which causes the water to be forcibly expelled through nozzle 23, the starting position of the housing 16 being shown in solid lines, and the position of housing 16 as it is jerked rapidly rearwardly being shown in phantom lines.

It has been found that an efficient amusement device 11 is provided by making the housing 16 in the form of a truncated cone having a longitudinal axis together with the described open large end 21 and open small end 22. Preferably, the cone is made of rigid or semi-rigid material capable of holding its shape while in operation and is made of buoyant material so it will float when left unattended in the body of water 13.

Figure 3:
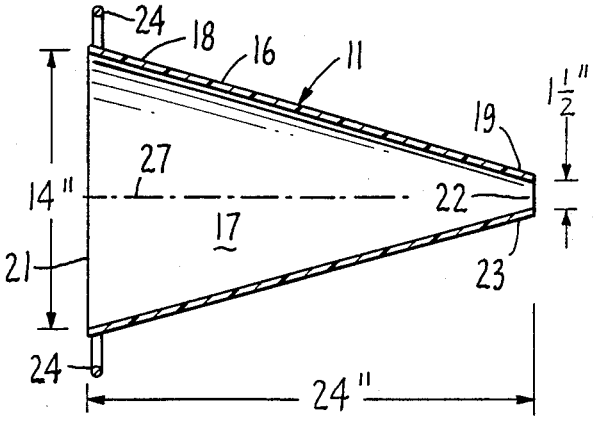
FIG. 3 is a vertical cross-sectional view on an enlarged scale of the water cannon of FIG. 1 showing relative proportions found to be particularly effective for the described purposes.

Suitable dimensions for the conical housing 16 are indicated in FIG. 3 of the drawings, where the open base of the cone 21 is approximately 14 inches in diameter, the height of the cone is 24 inches, and the opening providing the nozzle 23 is approximately 1½ inches.

Figure 4:
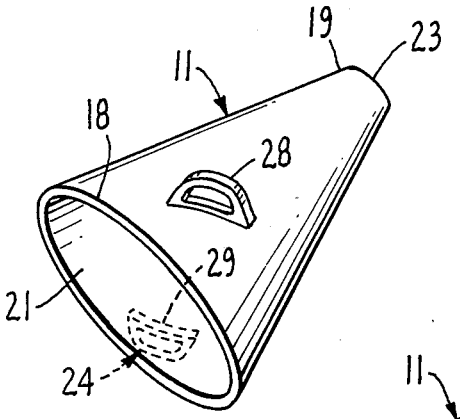
FIG. 4 is a perspective view of the water cannon showing externally handles.
Figure 5:
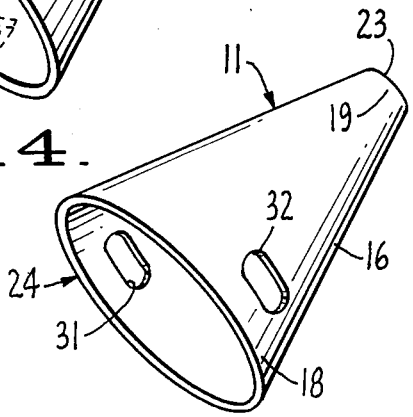
FIG. 5 is a view similar to FIG. 4, but showing handles provided by cutting diametrically opposed openings in the wall of the device.

FIG. 4 of the drawings illustrates opposed handles 28 and 29 mounted in diametrically opposed relation on the outside of the cone near the large end 21. FIG. 5 of the drawings illustrates opposed handles provided by openings 31 and 32 through the wall of the cone on diametrically opposite sides thereof near the large end 21.

Figure 6:
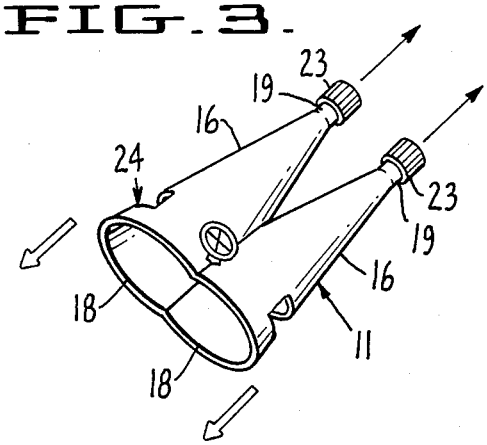
FIG. 6 is a perspective view of a dual water cannon constructed in accordance with the present invention.

It has been found that two or more of the conical housings can be provided and held together so that their longitudinal axes 27 are parallel so that the jets of water eminating therefrom also are substantially parallel. A unit of this type incorporating a pair of conical housings is illustrated in FIG. 6 of the drawings. As there shown, if desired the nozzles 23 can be formed to resemble the mouths of rapid fire guns, and the simulated gun sight may be carried on the joined housings 16, as shown.

From the foregoing, it will be apparent that the swimming pool water cannon of the present invention provides a novel structure and mode of use which makes it capable of projecting jets of water from the surface portion of a body of water over longer distances and with greater control than has heretofore been possible.

I claim:

1. A device for forcibly propelling a water jet from the surface portion of a body of water, comprising a truncated cone having a longitudinal axis together with an open large end communicating with an open smaller end, and manually engageable handle means on said cone formed for grasping and pulling said cone in the direction of said large end with said large end at least partially submerged in said body of water and said small end above the surface of said body of water so as to forcibly eject a jet of the water through said small end of said cone substantially along said axis in the direction opposite to the direction said cone is pulled by said handle means.

2. A device for forcibly propelling a water jet from the surface portion of a body of water as described in claim 1, and wherein said handle means comprises a pair of diametrically opposed manually accessible handles provided on said cone near said large end.

3. A device for forcibly propelling a water jet from the surface portion of a body of water as described in claim 2, and wherein said handle means is provided by openings through the wall of said cone on diametrically opposite sides thereof near said large end of said cone.

4. A device for forcibly propelling a water jet from the surface portion of a body of water as described in claim 1, and wherein said device is formed with a plurality of said cones with their said axes in generally parallel spaced relation whereby the jets of water are ejected from said cones in generally parallel relation to each other.

5. An amusement device for forcibly propelling a coherent water jet from a body of water, comprising a housing providing a generally tapering open passage from one end of said housing to the other end, the larger end of said passage being open and essentially unobstructed for admitting water freely into said passage when said larger end is at least partially submerged in said body of water, the smaller end of said passage being formed to provide a constricted nozzle whereby quantities of water forced into said passage through said larger end are accelerated and ejected forcibly through said nozzle to form a substantially coherent water jet capable of traversing significant distances before breaking up, and manually engageable handle means on said housing formed for pulling said housing rapidly through the surface layer of said body of water in the direction of said larger end and with said nozzle above the surface of said body of water so as to force quantities of water into the larger end of said passage and forcibly eject a jet of water through said nozzle.

* * * * *